US008378793B1

(12) United States Patent
Bryant

(10) Patent No.: US 8,378,793 B1
(45) Date of Patent: Feb. 19, 2013

(54) VERBALLY PROMPTING INDICATOR DEVICE USING VERBAL HUMANLIKE VOICES IN CONNECTION WITH SCUBA TANKS, DIVE COMPUTERS AND OTHER DIVE EQUIPMENT FOR IMPROVED UNDERWATER DIVING PERFORMANCE

(76) Inventor: Terry Keith Bryant, Singer Island, FL (US)

( * ) Notice: Subject to any disclaimer, the term of this patent is extended or adjusted under 35 U.S.C. 154(b) by 655 days.

(21) Appl. No.: 12/504,992

(22) Filed: Jul. 17, 2009

Related U.S. Application Data

(60) Provisional application No. 61/081,922, filed on Jul. 18, 2008.

(51) Int. Cl.
*G08B 3/00* (2006.01)

(52) U.S. Cl. ..... 340/384.1; 340/384.73; 340/391.1

(58) Field of Classification Search ..... 340/384.1, 340/505, 612, 850, 384.73, 391.1; 73/293, 73/700, 290 R
See application file for complete search history.

(56) References Cited

U.S. PATENT DOCUMENTS

| | | | | |
|---|---|---|---|---|
| 4,999,606 | A * | 3/1991 | Comerford et al. | 340/525 |
| 5,457,284 | A * | 10/1995 | Ferguson | 128/201.27 |
| 6,125,080 | A * | 9/2000 | Sonnenschein et al. | 367/134 |
| 6,360,182 | B1 * | 3/2002 | Hales | 702/139 |
| 6,856,578 | B2 * | 2/2005 | Magine et al. | 367/134 |
| 7,144,198 | B2 * | 12/2006 | Hirose et al. | 405/186 |
| 8,091,422 | B2 * | 1/2012 | Felske et al. | 73/293 |

FOREIGN PATENT DOCUMENTS

JP 2002320701 A * 11/2002

* cited by examiner

*Primary Examiner* — Toan N Pham
(74) *Attorney, Agent, or Firm* — Daniel S. Polley, P.A.

(57) ABSTRACT

Improvements to existing diving tanks and dive computers are achieved through the use of an electronic device which employs audible, verbal, simulated, humanlike words or phrases to inform a user while underwater of dive information, including, but not limited to, gas volumes present in the tank, ascent rates, water temperature, depth levels, remaining time in the water, etc. In one embodiment a microcontroller can be used to facilitate the different settings and information that the talking tank or dive computer supplies. The electronic assembly of the present invention can be in communication with the existing pressure gauges, sensors, and valves associated with the talking tank or dive computer.

17 Claims, 2 Drawing Sheets

Present Invention Within Separate Housing

Present Invention Within Separate Housing

VERBALLY PROMPTING INDICATOR DEVICE USING VERBAL HUMANLIKE VOICES IN CONNECTION WITH SCUBA TANKS, DIVE COMPUTERS AND OTHER DIVE EQUIPMENT FOR IMPROVED UNDERWATER DIVING PERFORMANCE

This application claims the benefit of and priority to U.S. Application Ser. No. 61/081,922, filed Jul. 18, 2008, which is incorporated hereto by reference in its entirety.

FIELD OF THE INVENTION

The present invention relates to improving conventional SCUBA (self-contained underwater breathing apparatus) and diving equipment, such as but not limited to SCUBA tanks, dive computers and components necessary for proper diving procedures and other dive equipment used in underwater diving activities. In conjunction with a demand regulator, the SCUBA tank dispenses oxygen, nitrox, air, pure oxygen, trimix, heliox or other helium-based gas or any other gas or combination of gases used for underwater diving activities (collectively referred to herein as "gas" or "breathing gas") under high pressure to a diver while underwater, in which the gas contained within the tank is dispensed to the underwater diver (also referred to as "user" herein), in relationship to his or her underwater breathing needs.

BACKGROUND OF THE INVENTION

Dive computers are used by divers for determining the time and depth of a dive to permit a proper ascent rate to be calculated and displayed on the computer display or screen, such as but not limited to, a LCD screen. The displayed information helps to prevent the diver from experiencing physical complications from ascending too quickly or for remaining underwater too long. Some of the typical kinds of information displayed on the LCD screen can include (1) current depth, (2) maximum depth reached on the current dive, (3) the time remaining at the current depth without the need for decompression stops on ascent; (4) dive time (5) required decompression stop depth and time, (6) water temperature, and (7) ascent rate.

Certain dive computers are designed to display information from a diving cylinder pressure sensor, such as gas pressure and estimated remaining time based on available gas and rate of gas consumption. Additionally, certain dive computers have warning buzzers that warn the diver of events such as (1) excessive ascent rates, (2) missed decompression stops, (3) maximum operation depth exceeded, and (4) oxygen toxicity limits exceeded. However, this requires the diver to remember what each buzzer sound represents.

SUMMARY OF THE INVENTION

The present invention improves upon existing diving tanks and dive computers and components necessary for proper diving procedures through the utilization of an electronic enhancement device which employs audible, verbal, simulated, generated, synthesized, or any similar process to provide vocalization of a humanlike voice, word, words, or phrases to inform the user of dive information, including, but not limited to, the exact volumes, rations, or whatever amount of gas or status thereof that is present in the tank gas container, ascent rates, water temperature, depth levels, inform a diver of his or her actual descent at a certain distance (i.e. every ten feet, etc.), inform a diver when he or she reaches a planned dive depth, inform a diver of his or her remaining down time at a specific depth, inform a diver of his or her remaining down time in certain time intervals based on the diver's current usage rate, inform the diver when it time to go up to ensure adequate time for planned safety stops, remind a diver not to hold his or her breath on ascent, inform the diver if his or her ascent rate is too fast, inform the diver when to stop for various decompression points and when to continue ascent, etc., to ensure safety per established or recommended guidelines.

The electronic device can also verbally indicate to the diver whether the tank is almost empty, completely full, or provide audible, verbal indication of percentage of volume in which said gas is contained. The electronic device can also verbally indicate when the reserve level in the tank has been reached, to alert the diver to terminate the dive to ensure that a sufficient amount of gas remains in the tank for the diver to safely reach the water surface. Other underwater readings and measurements can also be verbally indicated by the present invention including but not limited to, depth level, rate of ascent, rate of descent, etc., as well as those readings and measurements mentioned above. The information verbally provided by the present invention can be also used to confirm the accuracy of the same information being visually indicated by the user's dive computer.

Thus, the main purpose of the present invention is to provide audible, verbal, status of the volumes and amount of gas remaining in the tank, ascent and depth information, as well as to provide other relevant information related to an underwater activity. In order to provide the talking tank, dive computer or other dive equipment with the appropriate functions, in a preferred embodiment, a microcontroller, but not limited to, can be used to facilitate the different settings and information that the talking tank, dive computer, etc. can supply in conjunction with the adequate components to provide an audible, verbal, simulated, generated, synthesized, etc. responses and that can provide humanlike, words, or phrases, or a single word, of the relevant dive related information, as herein mentioned. Thus, the talking tank, dive computer, etc. can provide an immediate verbal indication to the user of gas volumes, depth levels, ascent rates, descent rates, reserve levels, etc., as well as serving to confirm information provided by a diver computer worn by the user through the sound of an audible, verbal, humanlike, simulated generated, synthesized, or any similar process.

The electronic assembly of the present invention can be in communication with the existing pressure gauges, sensors, and valves associated with the tank, dive computer, etc. Furthermore, additional gauges, sensors, valves, etc. can also be provided in order obtain the various readings which can be provided by the present invention tank.

Thus, with the conception of the talking tank, dive computer and other dive equipment, a significant advancement in underwater diving has been made, as diver safety, while underwater has been enhanced through the utilization of the present invention employing audible, verbal, human-like voices to inform the user of the gas status in his or her tank, while also verbally providing other valuable diving information to the user during the underwater activity.

Accordingly, it is the intention of the present invention through audible/verbal means to increase the safety of the dive, while at the same increasing the enjoyment of the user's underwater diving experience.

All components of the present invention can either be housed in waterproof housings or will be tolerable to being in contact with fresh and/or salt water and increases and decreases in underwater pressure due to depth changes.

BRIEF DESCRIPTION OF THE DRAWINGS

General block diagram illustrations for one embodiment of the present invention, which are not considered limiting in any way, are shown in FIGS. 1 and 2.

DETAILED DESCRIPTION OF THE INVENTION

Figure 1:
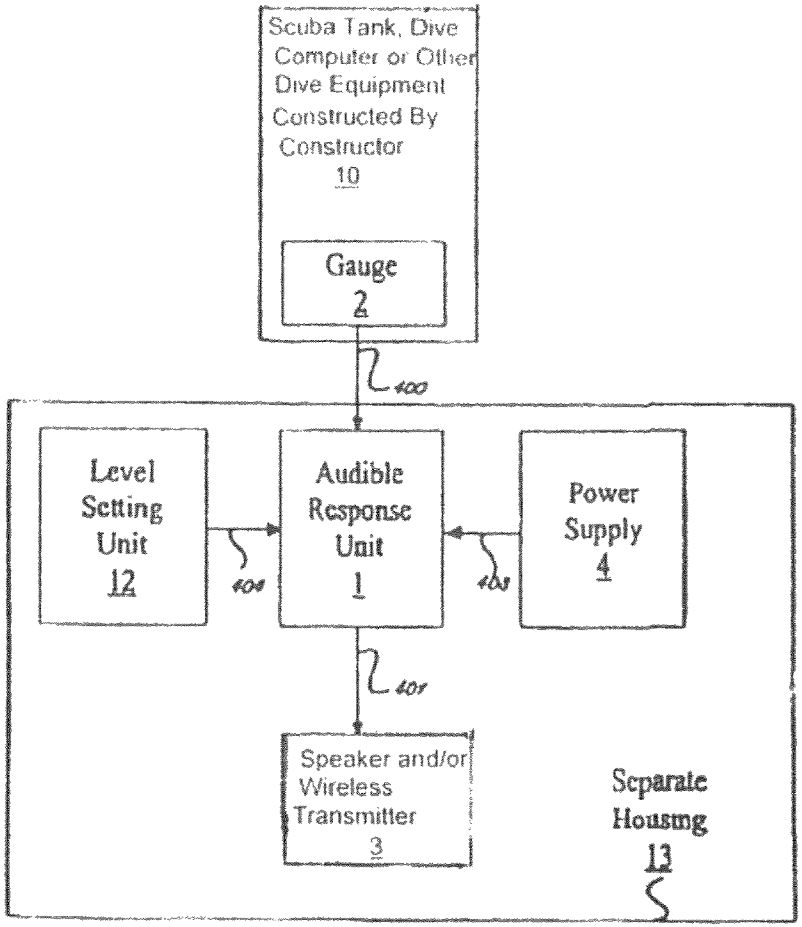

The present invention improves upon existing diving tanks, SCUBA tanks, oxygen tanks and diving cylinders (collectively referred to as "tank" or "tanks" herein) and dive computers and components necessary for proper diving procedures through the utilization of an electronic enhancement device which employs audible, verbal, simulated, generated, synthesized, or any similar process to provide vocalization of a humanlike voice, word, words, or phrases to inform the user of dive information, including, but not limited to, the exact volumes, rations, or whatever amount of gas or status thereof that is present in the tank gas container, ascent rates, water temperature, depth levels, inform a diver of his or her actual descent at a certain distance (i.e. every ten feet, etc.), inform a diver when he or she reaches a planned dive depth, inform a diver of his or her remaining down time at a specific depth, inform a diver of his or her remaining down time in certain time intervals based on the diver's current usage rate, inform the diver when it time to go up to ensure adequate time for planned safety stops, remind a diver not to hold his or her breath on ascent, inform the diver if his or her ascent rate is too fast, inform the diver when to stop for various decompression points and when to continue ascent, etc., to ensure safety per established or recommended guidelines.

The electronic device can also verbally indicate to the diver whether the tank is almost empty, completely full, or provide audible, verbal indication of percentage of volume in which said gas is contained. This function can also alternatively or additionally be adjusted or provided by manual pressing or selection of a button or similar responsive unit by the diver to perform automatically or manual adjustments. The electronic device can also verbally indicate when the reserve level in the tank has been reached, to alert the diver to terminate the dive to ensure that a sufficient amount of gas remains in the tank for the diver to safely reach the water surface. Other underwater readings and measurements can also be verbally indicated by the present invention including but not limited to, depth level, rate of ascent, rate of descent, etc., as well as those readings and measurements mentioned above. The information verbally provided by the present invention can be also used to confirm the accuracy of the same information being visually indicated by the user's dive computer.

To achieve the novel functions provided by the present invention, as described herein, are accomplished through novel technology which can comprise of a novel combination of existing electronic components such as but not limited to: microchips, microcontrollers, integrated circuit controllers, coin cells, power sources, batteries (rechargeable or non-rechargeable), electronic circuitry, wireless circuitry, wireless transmitters and receivers, multiplex circuits, electrodes, mylar speakers, speakers, sound modules, inductors, electro chromium, PC boards, inductive sensory systems, electrolyte layers, voltage regulators, oscillators, hardware, software, firmware, indicators, etc. The electronic components will be housed in a waterproof housing which can either be separate from the tank but in communication with the internal area of the tank or provided as part of the tank during the manufacturing process. In order to produce an audible, verbal humanlike voice as herein described the electronic device can also include an audio response unit, which can include an audio storage unit, audio amplifier, etc. Alternatively, the electronic assembly for verbal indication can be housed within the dive computer and be in communication with the electronics, circuitry, algorithms, etc. that generate the information visually provided by the dive computer. A speaker can be provided for verbally providing the information usually visually displayed on a dive computer such as a LCD display or similar unit which will provided through the present invention provide an audible verbal indication in synthesis with the dive computer directly or through being transmitted to the headsets, ear phones, etc. worn by the user.

Though certain components or combination of components needed for achieving the novel functions of the present invention may be described generally herein, it should be understood that the invention is not limited to any specific technology. Accordingly, any new, current, past, and/or future technology, and all combinations thereof, which can achieve the unique functions of the present invention discussed herein can be used and all are considered within the scope of the invention. Thus, the invention covers all past, current and future technology that will produce and provide audible, verbal, simulated, generated, or prerecorded humanlike voices of phrases, verbal commands, responses, or informative information to a user while underwater.

When used in connection with the tank, the present invention also encompasses providing audible beeps, tones, artificial sounds or noises (collectively referred to "non-verbal sounds") to the diver which can represent different levels of remaining gas volume contained within the tank. Non-verbal sounds could also be generated and provided to the user to represent different depth levels, as well as to notify the user if he or she is descending or ascending too rapidly. Preferably, the non-verbal sounds features are provided in addition to the humanlike voice information discussed above though not required. However, it is also within the scope of the invention to provide these features as an alternative to providing audible humanlike voice information to the underwater user as needed or deemed necessary.

The word humanlike encompasses the use of audible, verbal words, or phrases or a single word that may sound different in a variety of tones, such as a talking or speaking human or fictional animal, simulated or generated voices, or similar voice animation's to produce a humanlike sound, as described herein. The variation of humanlike sounds can include many different characteristics of audible, verbal, simulated, generated, or synthesized words or a single word and all are considered to consist of sounding like human words. The present invention is not limited to any specific language and can be provided in more than one language, with the user selecting his or her language of choice.

The talking tank in synthesis with a dive computer, the diver worn dive computer, or other dive equipment, includes the parts needed for the tank, dive computer, etc. along with any or all parts of whatever equipment or components needed to provide the audible verbal, response information and messages. As non-limiting examples, the present invention electronics can include voice chips or modules or any similar device, which can produce, generate, or synthesize a humanlike voice, as aforementioned. The present invention can provide word, words and/or phrases as applicable and can audible, verbal responses, commands, instructions, and/or information to the user to enhance the user's diving experience.

Thus, the main purpose of the present invention is to provide audible, verbal, status of the volumes and amount of gas remaining in the tank, ascent and depth information, as well as to provide other relevant information related to an underwater activity. In order to provide the talking tank, dive computer or other dive equipment with the appropriate functions, in a preferred embodiment, a microcontroller, but not limited to, can be used to facilitate the different settings and information that the talking tank, dive computer, etc. can supply in conjunction with the adequate components to provide an audible, verbal, simulated, generated, synthesized, etc. responses and that can provide humanlike, words, or phrases, or a single word, of the relevant dive related information, as herein mentioned. Thus, the talking tank, dive computer, etc. can provide an immediate verbal indication to the user of gas volumes, depth levels, ascent rates, descent rates, reserve levels, etc., as well as serving to confirm information provided by a diver computer worn by the user through the sound of an audible, verbal, humanlike, simulated generated, synthesized, or any similar process.

In one embodiment, the produced voice or voices can originate directly from the talking tank or dive computer and can be sufficiently loud enough such that voices can be heard underwater by the user through a speaker in communication with the electronic assembly. Alternatively, a transmitter can be provided as part of the electronic assembly for transmitting the verbal, audible information and/or non-verbal sounds wireless to a headphones, headset, speaker, earphones, etc. (capable of being used underwater) worn by the user. Additionally, given the typical close proximity of the tank(s) to the user's ears, wired headphones, headsets, speakers, ear phones, etc. (capable of being used underwater) can also be used, with the wire or cord running from the electronic assembly associated with the tank to the headphones, headsets, speakers, earphones, etc. The wired or wireless versions can be covered and protected by the diver's wet suit/dry suit ("suit") or can be incorporated into the suit. It is also within the scope of the invention to use whatever form of deliverance of sound that is preferable and sufficient to create the best quality and though including, is not limited to direct earphones or water responsive sound production.

The present invention can verbally provide exact measurements and verbally inform the user as to the status of contained gas and other relevant dive information according to the aforementioned programmable functions. Where the invention informs the user that the gas reserve level has been reached and determines that the user is not ascending, the invention can be programmed to continuously send warning messages to the user to return to the water surface before the gas within the tank is completely consumed.

The electronic assembly of the present invention can be in communication with the existing pressure gauges, sensors, and valves associated with the tank, dive computer, etc. Furthermore, additional gauges, sensors, valves, etc. can also be provided in order obtain the various readings which can be provided by the present invention tank. The various gas levels for providing information to the user can be set by the manufacturer or user of the talking tank, dive computer or can be adjustable by the user accordingly. The invention is not limited to any specific settings pre or post sale. Whether constructing the tank with additional gauges, valves, sensors and/or placing the electronic assembly in communication existing gauges, valves, etc., the talking tank, dive computer, etc. provides a novel approach for audibly/verbally informing the diver of various dive related information, as well as providing a way to confirm the accuracy of readings being displayed by the diver's dive computer. In the event a blind person wishes to experience the feelings of being underwater (preferably with a guide person), the benefits of the present invention audibly/verbally providing the dive information becomes even more beneficial.

The audible, verbal responses and information produced by the present invention can be through the use of a simulated, generated, synthesized, prerecorded human voice, or anything similar, as herein mentioned, in order to facilitate function, as herein described (male or female). An air pressure sensor, gauge, or similar device, can be installed at the appropriate location on the talking tank to detect and measure the exact amount of volumes and process and relay those accurate readings in order to supply audible, verbal verification of said readings as mentioned herein, which can correspond to the visual measurements shown on the gauge or dive computer. Depth sensors can also be similarly employed. The sensor(s), which will be in communication with circuitry and components necessary for operation, will be placed where needed with respect to the talking tank in order to achieve the goals of the present invention. The sensor(s) employed for measuring the amount of gas left in the tank can be connected directly to the area located at the source of where the gas is being dispersed.

In lieu of an air pressure sensor, the talking tank can also be provided with electronic sensors, which can attached directly in communication with the existing gauges (i.e. pressure gauges, etc.) at each numeric point or the pressure gauge hose. The present invention is not considered limited to any number of sensors and/or gauges and is also not considered limited to any specific location for the sensors and/or gauges.

As mentioned above, a speaker can be attached to whatever specifications or structure of the waterproof housing, on the aforementioned dive equipments, as needed in order to produce the required audible, verbal sound, as herein specified. Alternatively, the above noted wired or wireless headsets, headphones, speakers, etc. can be used. The talking tank and/or dive computer can have as many audible, verbal commands and responses as needed or required, supplying an audible, verbal, humanlike voice as herein described, according to the output potential employed and/or programmed. The various levels and readings are not considered limited to any percentages or any specific phrases, and all variations and combinations can be used and all are considered within the scope of the invention.

Another feature of the present invention is the ability to include a programmable timer for informing the user on the amount of time he or she has been participating in the underwater activity and/or to verbally let the user know that a certain period of time has elapsed and it is now time to return to the water surface. This feature is considered an additional feature which can be used with present invention but not necessarily mandatory to achieve the broad novel functions of the present invention. Thus, when the set time period has elapsed, the present invention will automatically vocalize such event to the user. This added safety feature will help assure that the user begins his or her return with enough gas remaining in the tank to reach the water surface. The talking tank and/or dive computer can be programmed to continue to inform the user periodically regarding the remaining amount of gas contained within the tank. Again, such updates can be provided through audible, verbal, humanlike voices, as described herein, using a word, words or phrase to accomplish this goal. The updates can be programmed to be based on amount of elapsed time or based on an amount of gas loss from within the tank.

A power source can be employed to operate the necessary components to facilitate the concept of the talking tank. Preferably, the power source can be rechargeable or non-rechargeable batteries. However, other power sources that can be used underwater, now known or later developed can also be used with the present invention and are considered within the scope of the invention.

Thus, with the conception of the talking tank, dive computer and other dive equipment, a significant advancement in underwater diving has been made, as diver safety, while underwater has been enhanced through the utilization of the present invention employing audible, verbal, human-like voices to inform the user of the gas status in his or her tank, while also verbally providing other valuable diving information to the user during the underwater activity. With the present invention, a diver, who may be focusing his or her attention on other underwater matters, can be automatically verbally alerted of the gas level within the tank and/or other dive information, without having to visually inspect gauges or a dive computer, through the employment of informative words and phrases produced by the talking tank or dive computer itself.

Though present invention provides the ability to replace previously visual provided information with audible, verbal, humanlike word, words or phrase, in order to prompt, command, instruct, inform, measure, guide or warn the user of his or her particular situation. With the present invention, information previously read and provided by a computer or microcontroller visually to the user, can now be provided audibly and verbally. Thus, the diver's underwater experience is not distracted with equipment readings, as the information is provided audibly/verbally to the diver, so that he or she can continue to concentrate on the underwater activity (i.e. viewing sea life, exploring sunken ships, etc.). Additionally, while focusing on the underwater activity, the user may also forget to visually check the equipment readings, which could lead to a dangerous underwater situation for the user. The present invention overcomes this problem, as the information is automatically provided to the user audibly/verbally without requiring the user to discontinue his or her current underwater activity. Thus, the present invention permits to user to freely dive, without having to worry about having to take the many inconvenient readings, which will be achieved automatically by the present invention. It is also within the scope of the invention to provide pre-water entry instructions audibly/verbally through the present invention before the user enters the water.

When used in conjunction with a dive computer, the present invention provides a voice prompting and indicating SCUBA dive computer, which takes information that is normally only visually available to the diver, and also or alternatively provides such information audibly to the diver. Thus, the diver will be prompted to perform everything that he or she is taught to do, but usually does not perform during the dive.

Accordingly, it is the intention of the present invention through audible/verbal means to increase the safety of the dive, while at the same increasing the enjoyment of the user's underwater diving experience.

All components of the present invention can either be housed in waterproof housings or will be tolerable to being in contact with fresh and/or salt water. Furthermore, being capable of being operable underwater will also require that the components selected for the present invention should also be able to operate under changing water pressure conditions in view of the ascent or descent of the diver.

Additionally, the present invention can be provided with a "check button" for manually checking proper operation of the one or more components of the present invention at any time.

Figure 2:
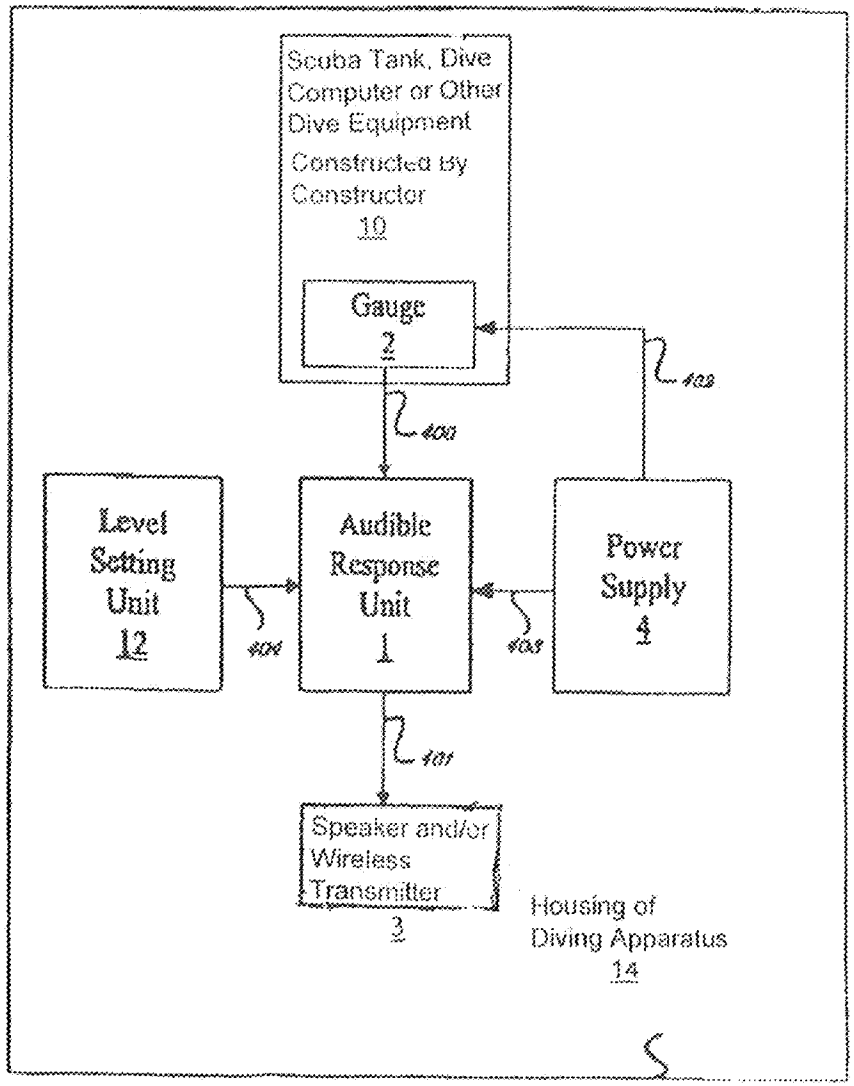

General block diagram illustrations for one embodiment of the present invention, which are not considered limiting in any way, are shown in FIGS. 1 and 2.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modifications disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. An improved tank for diving and other underwater conditions, comprising:

a dive tank having an internal area for storing a gas content;

a gauge or sensor in communication with the internal area of the dive tank; and means for verbally indicating in communication with said gauge or sensor and informing a person of at least one condition concerning the gas content contained within the dive tank, said means for verbally indicating housed within or secured to the dive tank.

2. The improved tank for diving of claim 1 wherein said person and dive tank are underwater and the dive tank is adapted to be worn by the person while said means for verbally indicates informs the person of the at least one condition.

3. The improved tank for diving of claim 1 wherein said means for verbally indicating comprising:

a microcontroller in communication with the gauge or sensor;

an audible response unit; and a power source wherein said microcontroller obtaining appropriate verbal humanlike voice messages from said audible response unit based on information received from the gauge or sensor.

4. The improved tank for diving of claim 3 further comprising a speaker positioned in hearing range proximity to the person or headphones adapted to be worn by the person, said speaker or headphones in communication with the microcontroller.

5. The improved tank for diving of claim 3 wherein said audible response unit comprising an audio storage unit containing a plurality of prerecorded verbal voice messages and an audio amplifier.

6. The improved tank for diving of claim 3 wherein said means for verbally indicating further comprising a wireless transmitter in communication with said microcontroller and wireless headphones adapted to be worn by the person for receiving verbal voice messages from the wireless transmitter for informing the person regarding the at least one condition.

7. The improved tank for diving of claim 1 further comprising a speaker positioned in hearing range proximity to the person or headphones adapted to be worn by the person, said speaker or headphones in communication with the means for verbally indicating.

8. An improved dive computer, comprising:

a dive computer having a housing and adapted to be worn by a person while the person is involved in a diving or other underwater activity; and means for verbally indicating to a person at least one condition concerning the dive or other underwater activity while the person is engaged in the dive or other underwater activity, said means for verbally indicating disposed within the housing of said dive computer.

9. The improved dive computer of claim 8 wherein said means for verbally indicating in communication with said dive computer.

10. The improved dive computer of claim 9 wherein said dive computer having a microcontroller and a power source and wherein said means for verbally indicating comprising:

an audible response unit; and a speaker or wireless transmitter;

wherein said microcontroller obtaining appropriate verbal humanlike voice messages from said audible response unit based on information received concerning the at least one condition which is heard by the person through the speaker or through headphones adapted to be worn by the person which receive the verbal humanlike voice messages from the wireless transmitter.

11. The improved tank for diving of claim 10 wherein said audible response unit comprising an audio storage unit containing a plurality of prerecorded verbal voice messages and an audio amplifier.

12. The improved dive computer of claim 8 wherein said dive computer is in communication with a gauge or sensor that is in communication with an internal area of a dive tank; wherein said dive computer receives information from said gauge or sensor regarding an amount of gas within the internal area of the dive tank.

13. The improved dive computer of claim 8 wherein said dive computer is adapted to be worn on a wrist area of the person.

14. An improved dive computer, comprising:

a dive computer having a housing and adapted to be worn on a wrist area of a person while the person is involved in a diving or other underwater activity, said dive computer having a microcontroller and power source disposed within said housing; and means for verbally indicating to a person at least one condition concerning the dive or other underwater activity while the person is engaged in the dive or other underwater activity, said means for verbally indicating disposed within the housing of said dive computer and in communication with said microcontroller and said power source.

15. The improved dive computer of claim 14 wherein said means for verbally indicating comprising:

an audible response unit; and a speaker or wireless transmitter;

wherein said microcontroller obtaining appropriate verbal humanlike voice messages from said audible response unit based on information received concerning the at least one condition which is heard by the person through the speaker or through headphones adapted to be worn by the person which receive the verbal humanlike voice messages from the wireless transmitter.

16. The improved tank for diving of claim 15 wherein said audible response unit comprising an audio storage unit containing a plurality of prerecorded verbal voice messages and an audio amplifier.

17. The improved dive computer of claim 14 wherein said dive computer is in communication with a gauge or sensor that is in communication with an internal area of a dive tank; wherein said dive computer receives information from said gauge or sensor regarding an amount of gas within the internal area of the dive tank.

* * * * *